US007967617B2

(12) United States Patent
Vonnegut et al.

(10) Patent No.: US 7,967,617 B2
(45) Date of Patent: Jun. 28, 2011

(54) TRAILER TOW CONNECTOR ASSEMBLY

(75) Inventors: Carl Vonnegut, Newton, MA (US); Neal Pugh, Taunton, MA (US); Aleksey Rybalnik, Framingham, MA (US); Todd Meaney, San Luis Obispo, CA (US); Per I. Karlsson, El Paso, TX (US); Oscar Lopez, Chih (MX)

(73) Assignee: Stoneridge Control Devices, Inc., Canton, MA (US)

( * ) Notice: Subject to any disclaimer, the term of this patent is extended or adjusted under 35 U.S.C. 154(b) by 0 days.

(21) Appl. No.: 12/564,394

(22) Filed: Sep. 22, 2009

(65) Prior Publication Data

US 2010/0105227 A1 Apr. 29, 2010

Related U.S. Application Data

(63) Continuation of application No. PCT/US2008/058054, filed on Mar. 24, 2008.

(60) Provisional application No. 60/896,395, filed on Mar. 22, 2007.

(51) Int. Cl.
*H01R 13/44* (2006.01)

(52) U.S. Cl. ..... 439/142; 439/76.1; 439/34

(58) Field of Classification Search ..... 439/142, 439/136, 76.1, 35, 34
See application file for complete search history.

(56) References Cited

U.S. PATENT DOCUMENTS

| | | | | |
|---|---|---|---|---|
| 6,130,487 | A | 10/2000 | Bertalan et al. | |
| 6,218,952 | B1 | 4/2001 | Borland et al. | |
| 6,447,302 | B1 * | 9/2002 | Davis | 439/34 |
| 7,064,658 | B2 | 6/2006 | Burlak et al. | |
| 7,331,792 | B2 | 2/2008 | Cummings et al. | |
| 2002/0125771 | A1 | 9/2002 | Kaminski | |
| 2003/0020331 | A1 * | 1/2003 | Burdick et al. | 307/9.1 |
| 2004/0115978 | A1 * | 6/2004 | Hedayat et al. | 439/136 |
| 2006/0085099 | A1 | 4/2006 | Burlak et al. | |

OTHER PUBLICATIONS

International Preliminary Report on Patentability dated Sep. 22, 2009 issued in related International Patent Application No. PCT/US2008/058054.

International Search Report and Written Opinion dated Sep. 22, 2009 issued in related International Patent Application No. PCT/US2008/058054.

* cited by examiner

*Primary Examiner* — T C Patel
*Assistant Examiner* — Travis Chambers
(74) *Attorney, Agent, or Firm* — Grossman, Tucker, Perreault & Pfleger, PLLC

(57) ABSTRACT

An electrical connector including a first connector portion and a second connector portion, and interface electronics for providing an interface between terminals associated with the first and second connector portions and a vehicle bus.

9 Claims, 12 Drawing Sheets

TRAILER TOW CONNECTOR ASSEMBLY

CROSS-REFERENCE TO RELATED APPLICATIONS

This is a continuation of International PCT Application Ser. No. PCT/US08/58054, filed Mar. 24, 2008, designating the United States, which claims the benefit of the filing date of U.S. Provisional Application Ser. No. 60/896,395, filed Mar. 22, 2007, the teachings of which applications are hereby incorporated herein by reference.

TECHNICAL FIELD

The present invention relates generally to electrical connectors, and, in particular, to electrical connectors for making electrical connections between a vehicle and an apparatus towed by the vehicle.

BACKGROUND

It is commonplace to provide an electrical connector on a vehicle for accepting a corresponding connector that is cable-connected to electrical components of a towed apparatus, e.g. a trailer, boat, etc. Because of the multiplicity of components in vehicles for such things as running lights, brake lights, and signal lights, as well as electric brakes and other auxiliary equipment, the vehicle connector may provide seven or more contact terminals, e.g. arrayed in a circular pattern about a central terminal. The towed apparatus, however, may not require connection to each contact terminal, and thus may include a connector having fewer contact terminals than the vehicle connector.

In such cases, adaptors have been developed for making appropriate electrical connections from a vehicle to a towed apparatus. For example, 7-way (on vehicle) to 4-way (on towed apparatus) adaptors are well known. Alternatively, vehicles have been provided with multiple connector types to eliminate the need for an adaptor. In one example, a vehicle may be provided with both 7-way and 4-way connectors, each having their own wiring harness and connections to the vehicle electrical system. When operating a towing vehicle for towing a trailer, problems can arise that may cause hazardous or unsafe driving conditions. For example, a light on a trailer may burn out or become disconnected, which may cause a driving hazard at night or in foggy conditions. In another situation, the trailer may include electrically assisted brakes, which may fail or become disconnected, resulting in increased stopping distance that may pose a driving hazard. Many of these driving hazards arise without notification to the driver. When the driver does not know that a hazardous condition exists, the driver cannot adjust driving techniques or immediately stop to fix of the failed component.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

A connector assembly consistent with the present disclosure may include interface electronics disposed in a housing thereof for interfacing the connector with a vehicle, e.g. a vehicle bus, and providing. The interface electronics may perform functions as described, for example, in U.S. Patent Publication No. US 2006/0085099, entitled "Method and System for Driving a Vehicle Trailer Tow Connector", the teachings of which are hereby incorporated herein by reference. In general, the interface electronics may be configured for communicating with a vehicle data network, and for switching, measuring, and managing power applied to pins of the connector for operating electronic devices on a towed trailer. The interface electronics may include a processor operating under software control. Software instructions for controlling the processor may be stored on a computer readable medium.

A connector assembly consistent with the present disclosure may place intelligent power control, testing, and power management in a small self-contained package that can be installed in place of a prior art trailer tow connector assembly. Additionally, assembly may be easily integrated into modern vehicle networks containing other intelligent modules, and it may be programmed to operate in a variety of different applications according to the specifications of different vehicle manufactures. The assembly may include protection mechanisms to avoid damage due to short circuits in trailer wiring by removing power when current exceeds predetermined limits When power is intelligently monitored and controlled, the need for replacing fuses may be eliminated, and power may be restored automatically when the short circuits are repaired or removed. The connector assembly consistent with the present disclosure may also conserve battery power in situations where lights have been left on and the battery is in danger of loosing the capacity to restart the vehicle.

Figure 1:
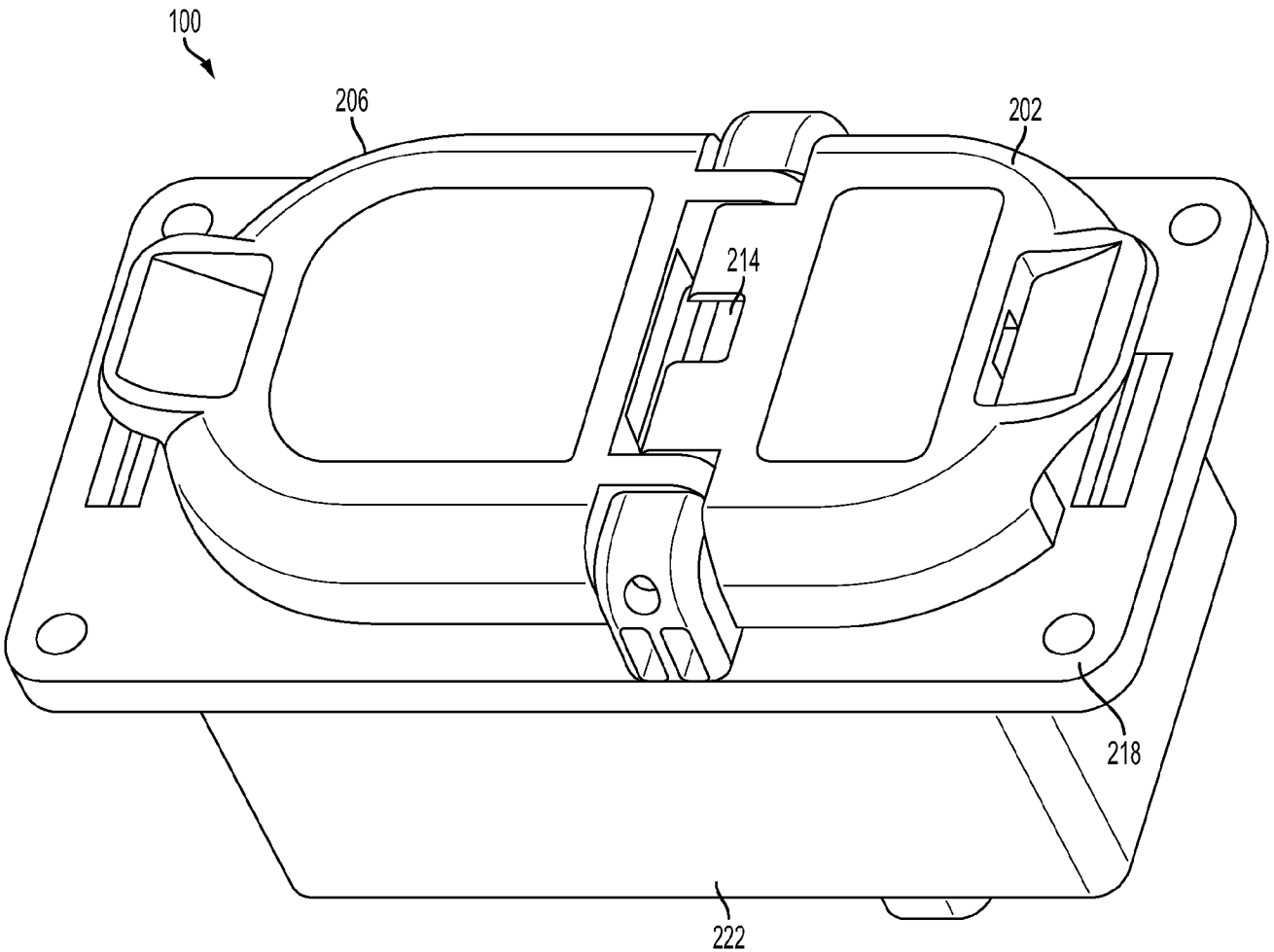
FIG. 1 is a perspective view of one exemplary connector assembly consistent with the present disclosure.
Figure 2:
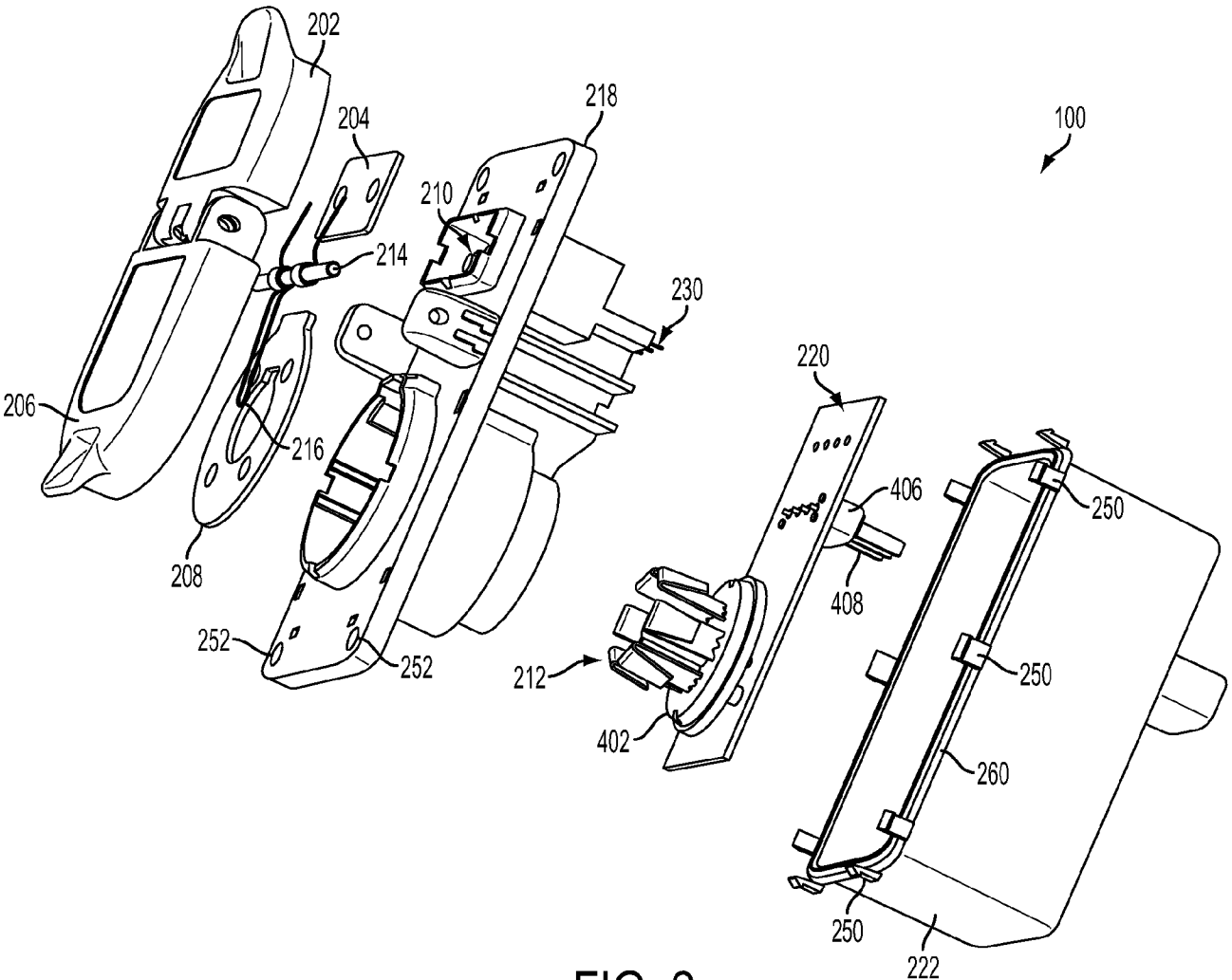
FIG. 2 is an exploded view of the exemplary connector assembly shown in FIG. 1.
Figure 3:
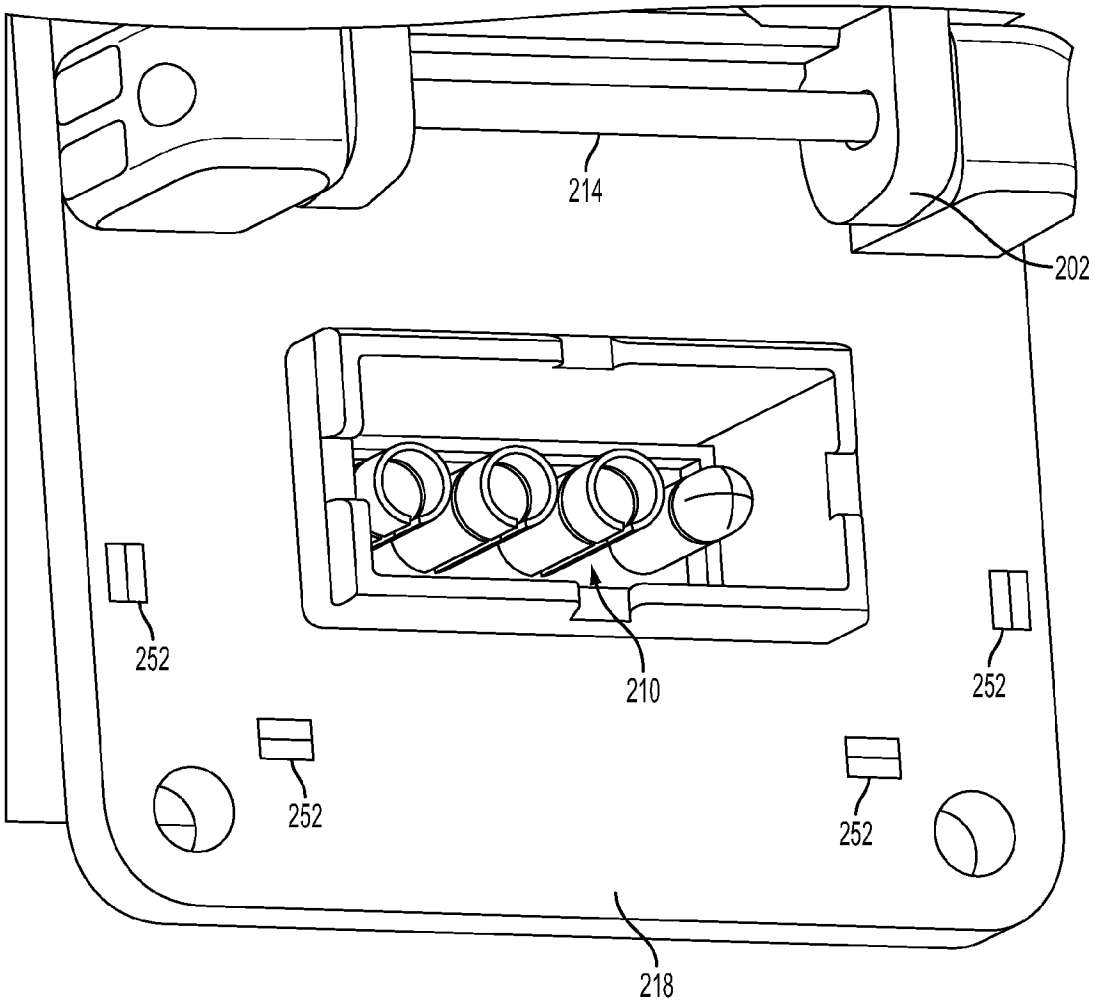
FIG. 3 is perspective view of a 4-way connector portion of the connector assembly shown in FIG. 1.

Embodiments of a connector assembly consistent with the present disclosure may be described in connection with a combined 4-way and 7-way connector interface as described in U.S. Pat. No. 7,331,792, there teachings of which are hereby incorporated herein by reference in their entirety. Turning to FIGS. 1-5, for example, there is illustrated one exemplary embodiment 100 of a connector assembly consistent with the present disclosure that allows a snap-together construction. As best shown in the exploded view of FIG. 2, the construction includes a 4-way connector interface cover 202 and gasket 204 for covering the 4-way interface electrical terminals 210, a 7-way connector interface cover 206 and gasket 208 for covering the 7-way interface electrical terminals 212; a hinge pin 214 and torsion spring 216 for biasing the covers 204 and 206 to a closed position over the terminals 210 and 212; a socket 218 having the 4-way interface electrical terminals 210 insert molded therein as shown in FIG. 3, a printed circuit board (PCB) assembly 220; and a cover 222.

The illustrated exemplary embodiment 100 provides a seven-way connector interface portion and a four-way connector interface portion and associated vehicle interface electronics in the same housing. The circuits of the seven-way connector interface and the four-way connector interface are combined in a manner requiring only a single wire harness. A towed apparatus having either a 4-way connector or a 7-way connector may thus be coupled to a vehicle wiring harness using a connector consistent with the present disclosure by electrically connecting the contacts of the towed apparatus connector to the contacts 210 or 212 of either the four-way connector interface portion or the 7-way connector interface portion, i.e. by lifting one of the covers 202, 206 and mating the towed connector with the interface.

Figure 4:
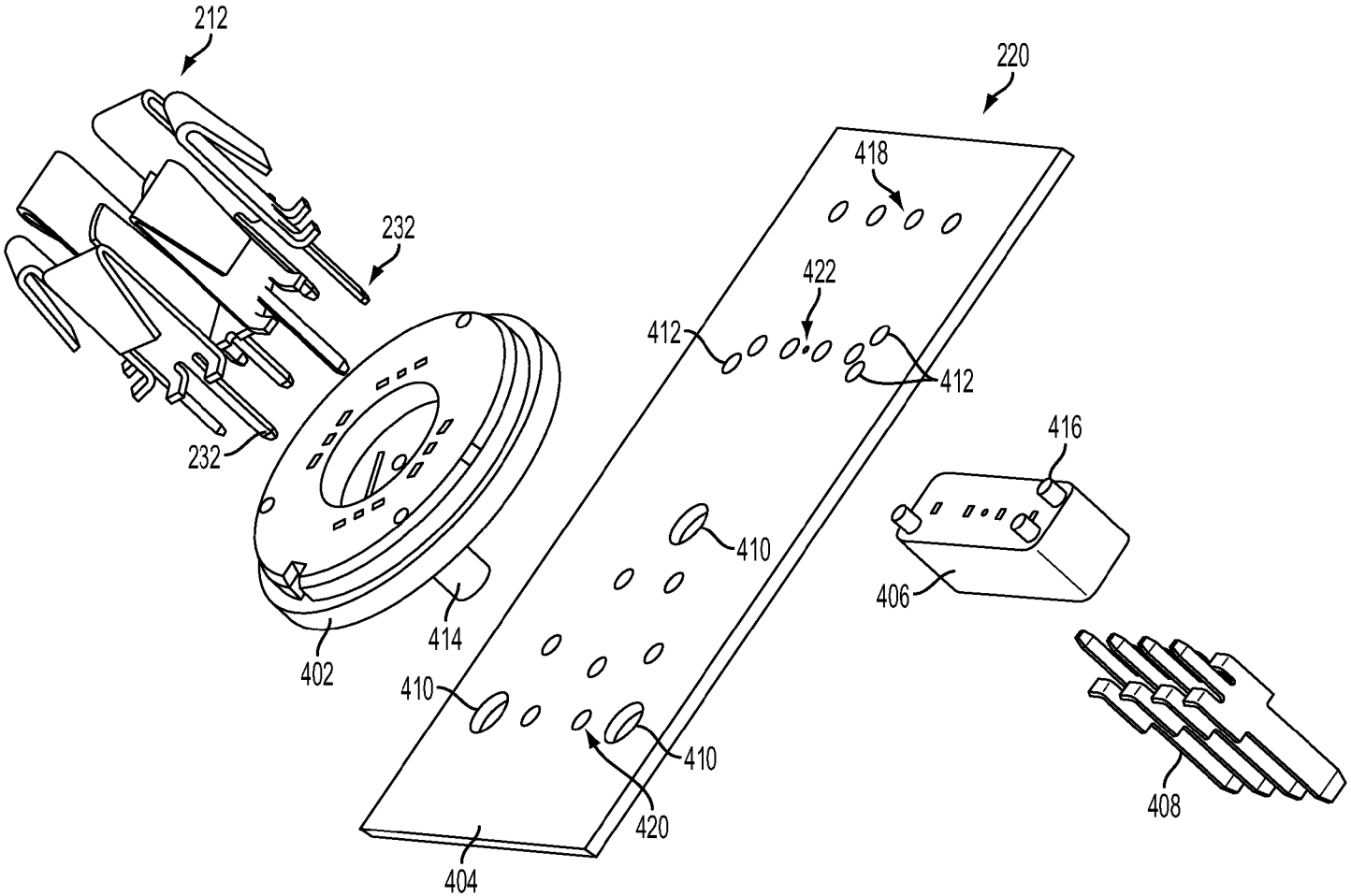
FIG. 4 is an exploded view of the PCB assembly portion of the connector assembly shown in FIG. 1.
Figure 5:
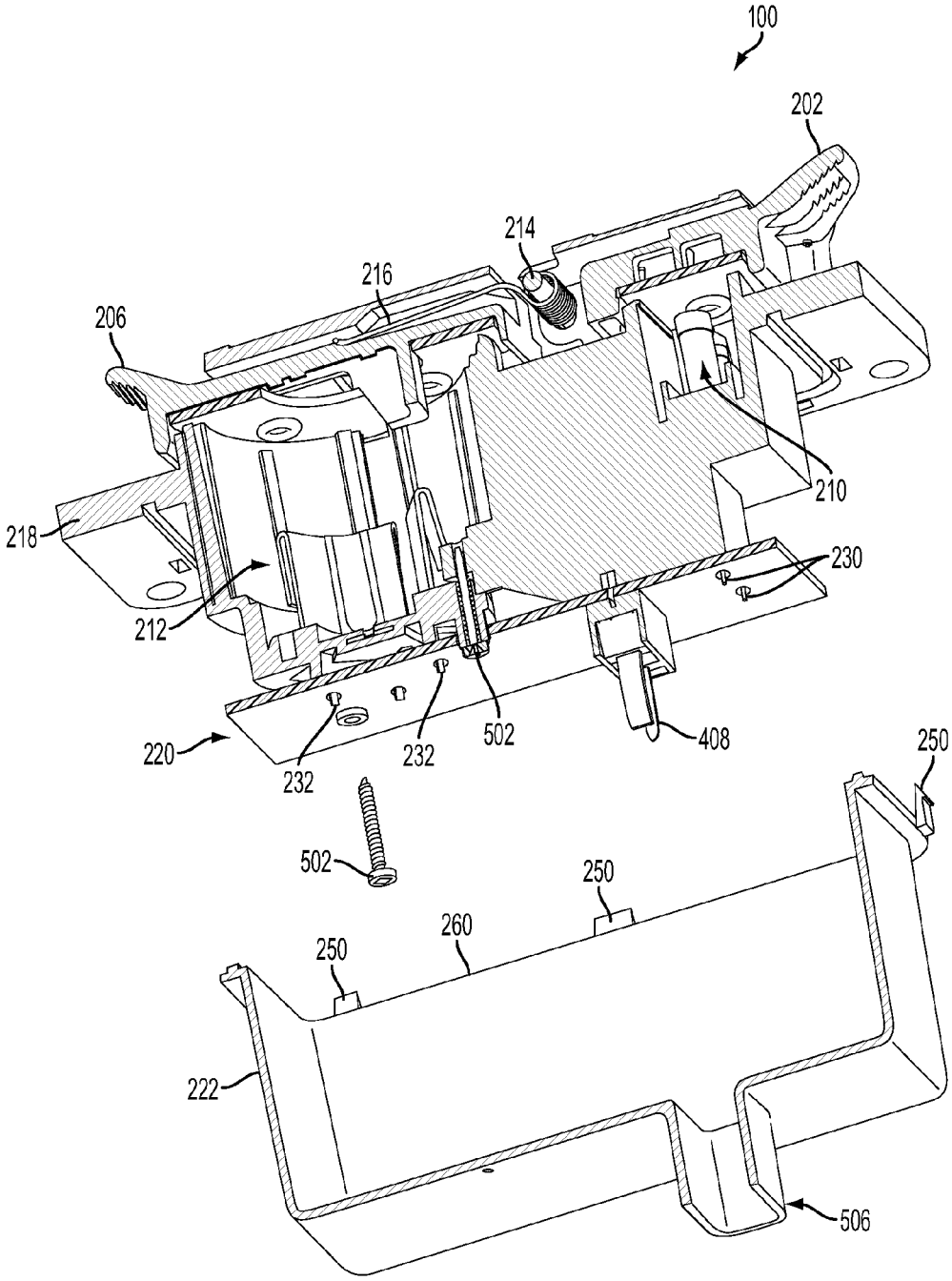
FIG. 5 is another exploded view of the exemplary connector assembly shown in FIG. 1.

As shown in FIG. 4, the PCB assembly may include the 7-way terminals 212, a 7-way terminal header 402, a single PCB 404, a harness connector terminal header 406, and harness terminals 408. The ends 230, 232 of the 4-way and 7-way contacts may extend beyond a bottom of the socket 218 and into electrical contact with associated interface electronics on the PCB assembly 220, e.g. as shown in FIG. 5. The PCB may include openings 410, 412 therethrough for receiving corresponding mounting pegs 414, 416 on the 7 way terminal header 402 and the harness connector header 406, respectively. The 7-way terminals 212 and harness terminals 408 may be mounted to the PCB through electrically insulating headers 402 and 406, respectively.

The PCB may also include associated openings therethrough for receiving the ends 230, 232 of the 4-way and 7-way terminals, respectively. The ends 230, 232 may be electrically connected to the interface electronics on the PCB, for providing an electrical interface to the vehicle bus through the harness terminals 408. The PCB may include openings 422 therethrough for receiving ends 424 of the harness terminals 408. The ends 230, 232 and 424 of the 4-way terminals, 7-way terminals, and harness terminals, respectively, may be inserted into the corresponding openings on the PCB and soldered to associated conductive traces thereon for making electrical contact between the terminals and the interface electronics on the PCB.

Figure 5A:
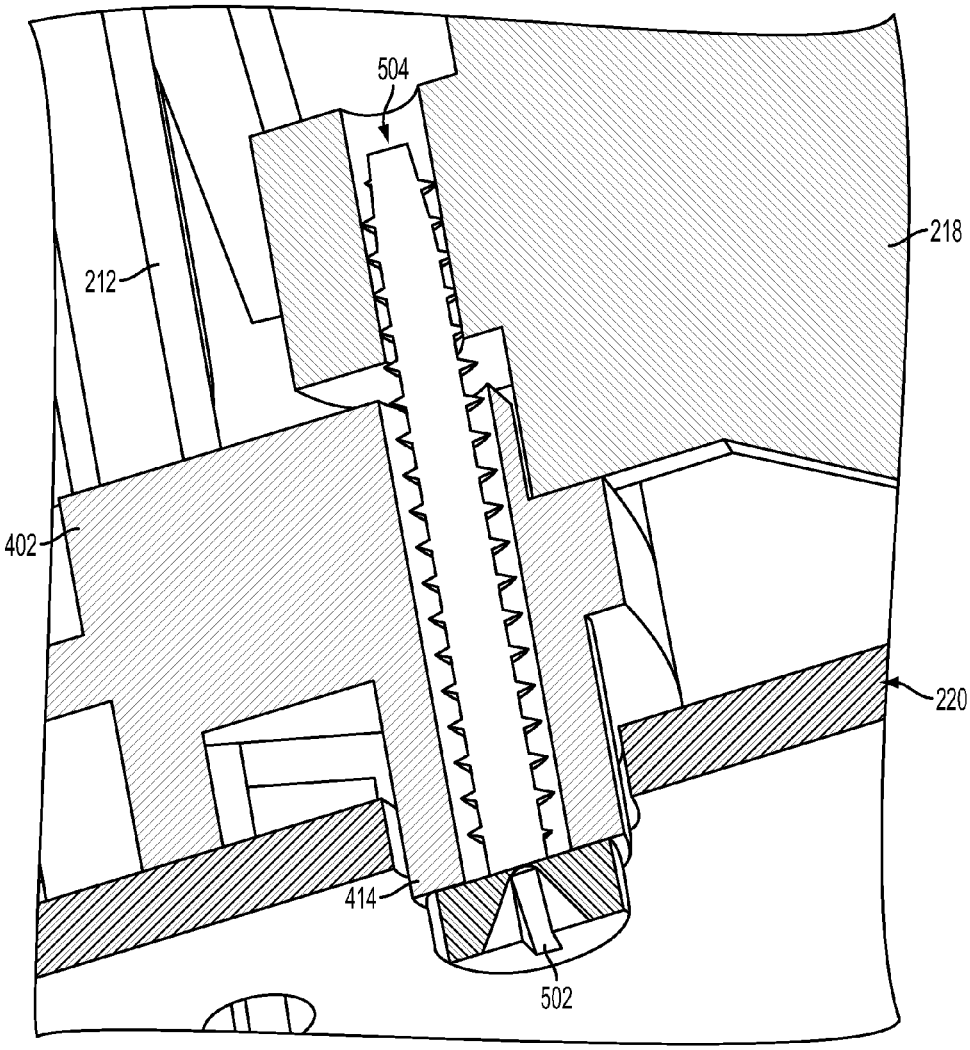
FIG. 5A is a detailed view of a portion of the connector assembly shown in FIG. 1.

As shown in FIG. 5, the PCB assembly 220 may be secured in the assembly using thread forming screws 502 extending from the bottom of the PCB assembly 220 through the pegs 414 of the 7-way terminal header 402, and into associated openings 504 in the socket 218. As shown in FIG. 5A, internal openings in the pegs 414 may align with associated openings 504 in the socket so that the screws 502 secure the PCB assembly through the 7-way terminal header 402 and the socket. This configuration may reduce or eliminate loads on the PCB assembly 220 during use.

With the PCB assembly 220 fastened to the socket 218, the cover 222 may be snap-fit to the socket by inserting the resilient tabs 250 on a top portion of the cover 222 into associated openings 252 in the perimeter of the socket 218. As the tabs pass through the openings, they may deflect inward and then outward to lock the cover to the socket and thereby enclosing the socket and PCB assembly 220, with the harness terminals 408 extending into a harness terminal connector portion 506 of the assembly 100. Prior to attaching the cover to the socket, an electronics grade RTV silicone sealant may be applied to the upper rim 260 of the cover for sealing the cover to the housing. In one embodiment, the RTV silicone sealant may be a commercially available sealant available from Dow Corning of Midland, Mich. under product identification DOW CORNING #739. The RTV sealant allows sealing of the assembly without application of thermal stress to the electronics and may be more robust than gaskets. Also, the sealant may withstand significant pressure differentials due to thermal shock and water immersion.

The harness terminals 408 provide an electrical interface to a vehicle data communication network. Examples of such networks include Society Of Automotive Engineers (SAE) J1850, Controller Area Network (CAN), and KWP2000. These communication protocols may be used for automobile inter-module communication. The physical communication bus of the vehicle data network may be implemented with a simple, two-wire differential serial bus system that can operate in noisy electrical-magnetic environments.

Local Interconnect Network (LIN) is another vehicle communication network used for communications and networking with a serial bus running between intelligent sensors and actuators. The LIN specification covers the data transmission protocol (the physical layer and the data link layer), and the transmission medium. The LIN bus is a class A protocol operating at a bus speed of 19,200 baud over a maximum cable length of 40 meters. LIN protocol was designed to communicate changes in switch settings and respond switch changes so that it communicates events that happen in "human" time (hundreds of milliseconds). LIN protocol supports bidirectional communication on a single wire, while using inexpensive microcontrollers. The protocol uses an autobaud step on every message. Transfer rates of up to 20 Kbaud are supported, along with a low power Sleep Mode, where the bus is shut down to prevent draining the battery, but can be powered up by any node on the bus.

Figure 6:
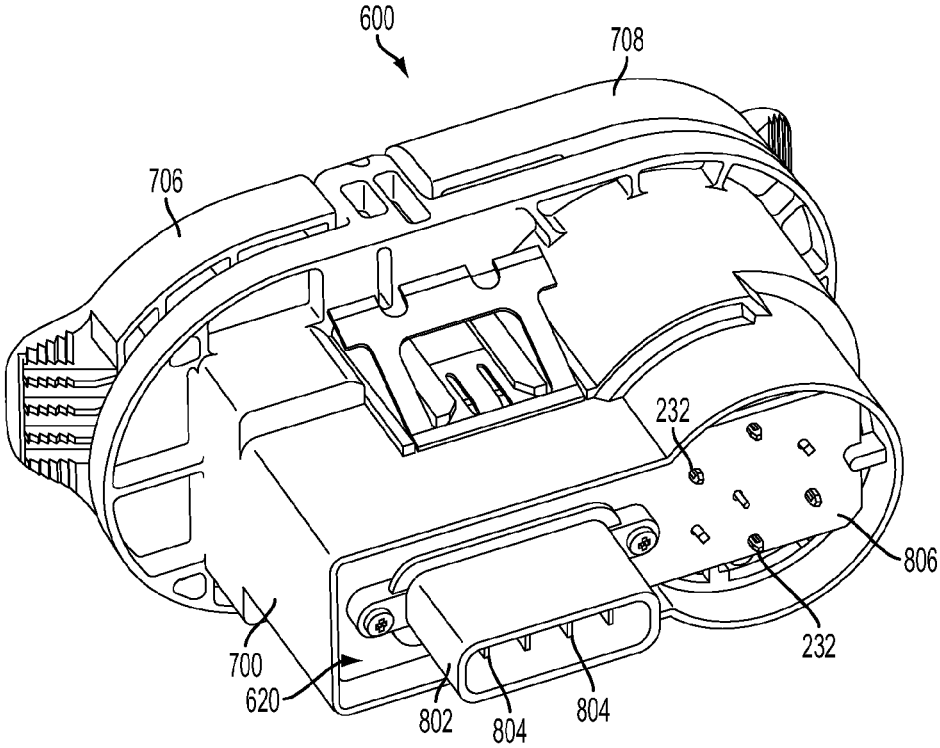
FIG. 6 is a perspective view of another exemplary connector assembly consistent with the present disclosure.
Figure 7:
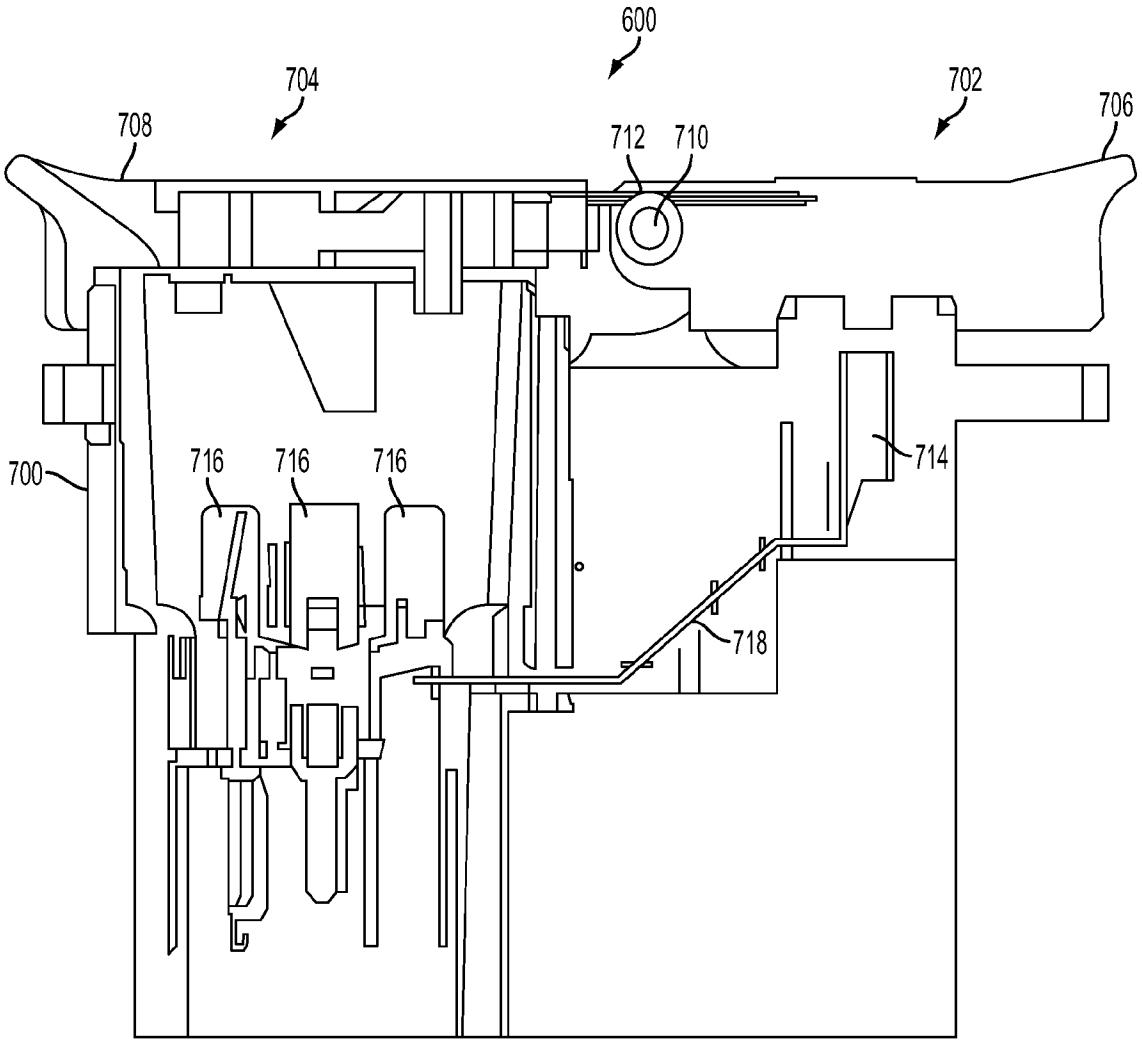
FIG. 7 is a sectional view of a portion of the connector assembly shown in FIG. 6.
Figure 8:
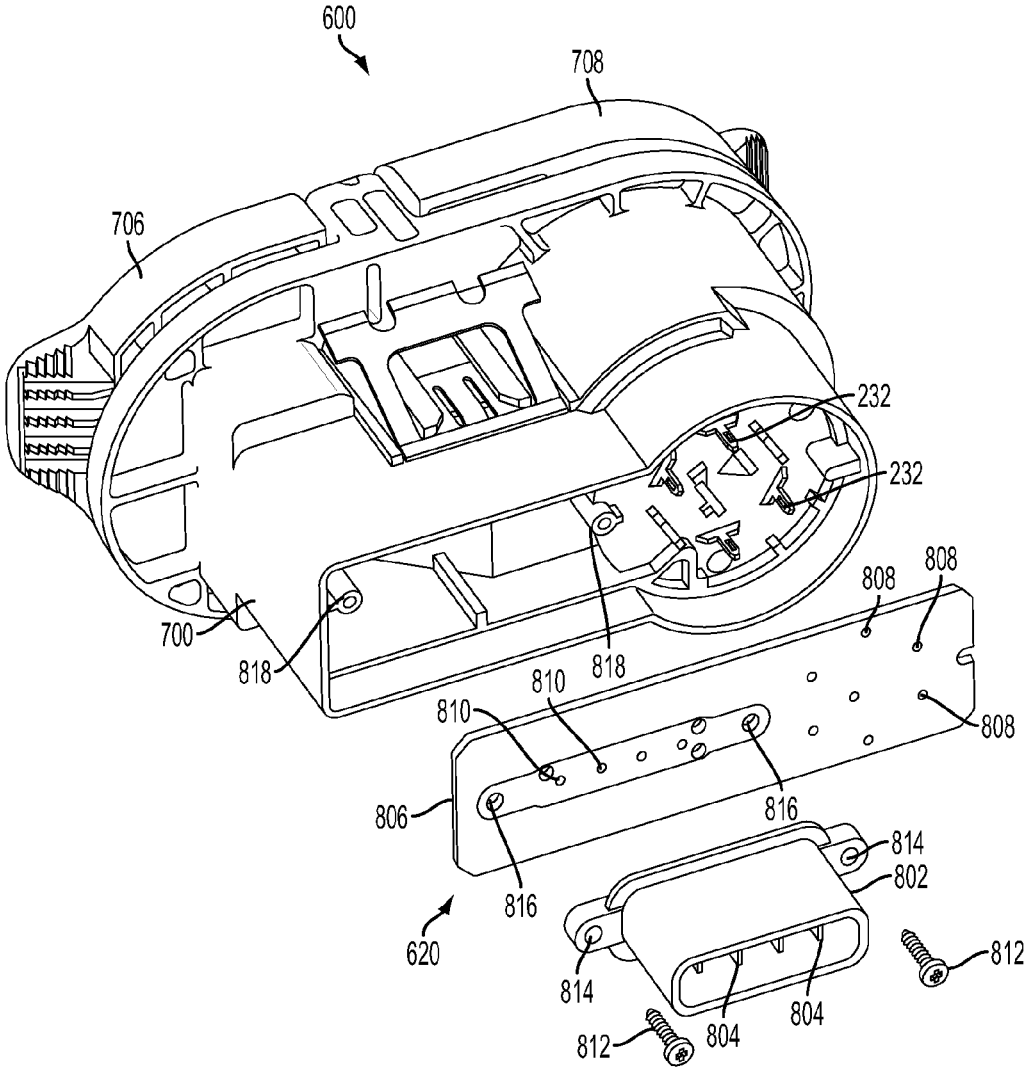
FIG. 8 is an exploded view of the exemplary connector assembly shown in FIG. 6.

FIGS. 6-8 illustrate an alternative embodiment of an assembly 600 consistent with the present disclosure. The illustrated exemplary embodiment 600 may be constructed generally as shown and described in connection with FIGS. 37-49 of U.S. Pat. No. 7,331,792, the teachings of which are incorporated herein by reference, except that interface electronics may be provided on a PCB assembly 620 for providing an interface to the vehicle bus.

FIG. 7, for example, is a cross-sectional view of a portion of the assembly not including the PCB assembly portion or the physical interface between the PCB assembly portion and the connector body. As shown, connector assembly 600 may include a body portion 700 including a first connector region 702 and a second connector region 704. The first connector region 702 may include a four-way connector and the second connector region 704 may include a seven-way connector. Each of the connector regions 702, 704 may include a cover portion 706, 708, respectively. As depicted, the cover portions 706, 708 may be pivotally disposed over the respective connector portions 702, 704. The cover portions 706, 708 may be pivotally coupled to the body portion 700 of the combination connector 700 via a common hinge pin 710. Additionally, the cover portions 706, 708 may each be biased toward a closed position by a single common spring 712. The arrangement of the cover portion 706, 708 may be such that only one cover portion 706, 708 may be open at a time. In an embodiment herein, one cover portion being in an open position may prevent the other cover portion from opening.

Each of the four-way connector portion 702 and the seven-way connector portion 704 may include associated four-way 714 seven-way terminals 716 respectively. According to an aspect of the present invention, the connector 700 may include a wiring bus provided by electrically coupling each terminal 714 of the first connector portion 702 with an associated one of the terminals 716 of the second connector portion 704. As shown, the wiring bus may include extensions 718 of the terminals 714, which may electrically couple the terminals 714 of the first connector portion 702 with the terminals 716 of the second connector portion 704.

As shown in FIGS. 8, the PCB assembly 620 may include harness terminal header 802; harness terminals 804, and a single PCB 806. As shown, the PCB 806 may include associated openings 808 therethrough for receiving the ends 232 of the 7-way terminals. The ends 232 may be electrically connected to the interface electronics on the PCB, for providing an electrical interface to the vehicle bus through the harness terminals 804. The PCB may include openings 810 therethrough for receiving ends of the harness terminals 804. The ends of the 7-way terminals and harness terminals may be inserted into the corresponding openings on the PCB and soldered to associated conductive traces thereon for making electrical contact between the terminals and the interface electronics on the PCB. The PCB assembly 620 may be secured to the housing 700 using thread forming screws 812 extending through openings 814 in flanges on the harness header 802, through corresponding openings 816 in the PCB 806 and into associated receptacles 818 on the housing 700. This configuration may reduce or eliminate loads on the PCB assembly 620 during use.

Figure 9:
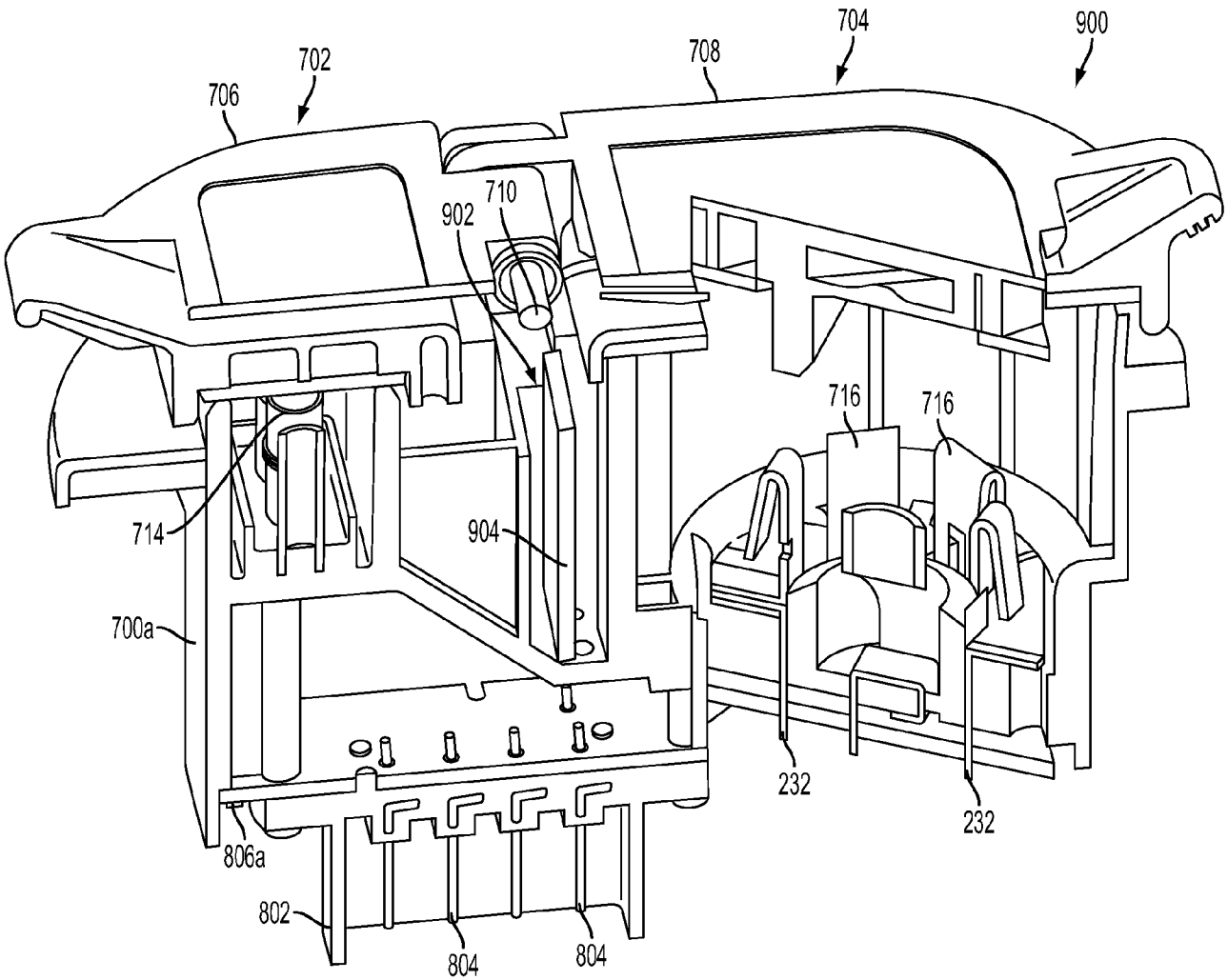
FIG. 9 is a sectional view of another exemplary connector assembly consistent with the present disclosure.

Turning now to FIG. 9, there is illustrated another exemplary embodiment 900 of a connector assembly consistent with the present disclosure. The illustrated exemplary embodiment 900 is substantially similar in construction to the embodiment illustrated in FIGS. 6-8, except that the interface electronics are separated onto first and second PCBs to allow a small overall package size for the assembly. In the illustrated exemplary embodiment, the assembly includes a housing 700*a* including a space 902 provided between the connector portions, e.g. generally beneath the pin 710. The space 902 may be dimensioned to receive a second PCB 904, i.e. in addition to the PCB 806*a*. The second PCB 904 may thus be oriented generally perpendicular to the PCB 806*a*, and the interface electronics may be distributed between the PCB 806*a* and the PCB 904, thereby reducing the space required on PCB 806*a* compared to the embodiment shown in FIGS. 6-8. The interface electronics on PCB 904 may be electrically coupled to the electronics on the PCB 806*a* by associated pins, wiring connections or traces.

Figure 10:
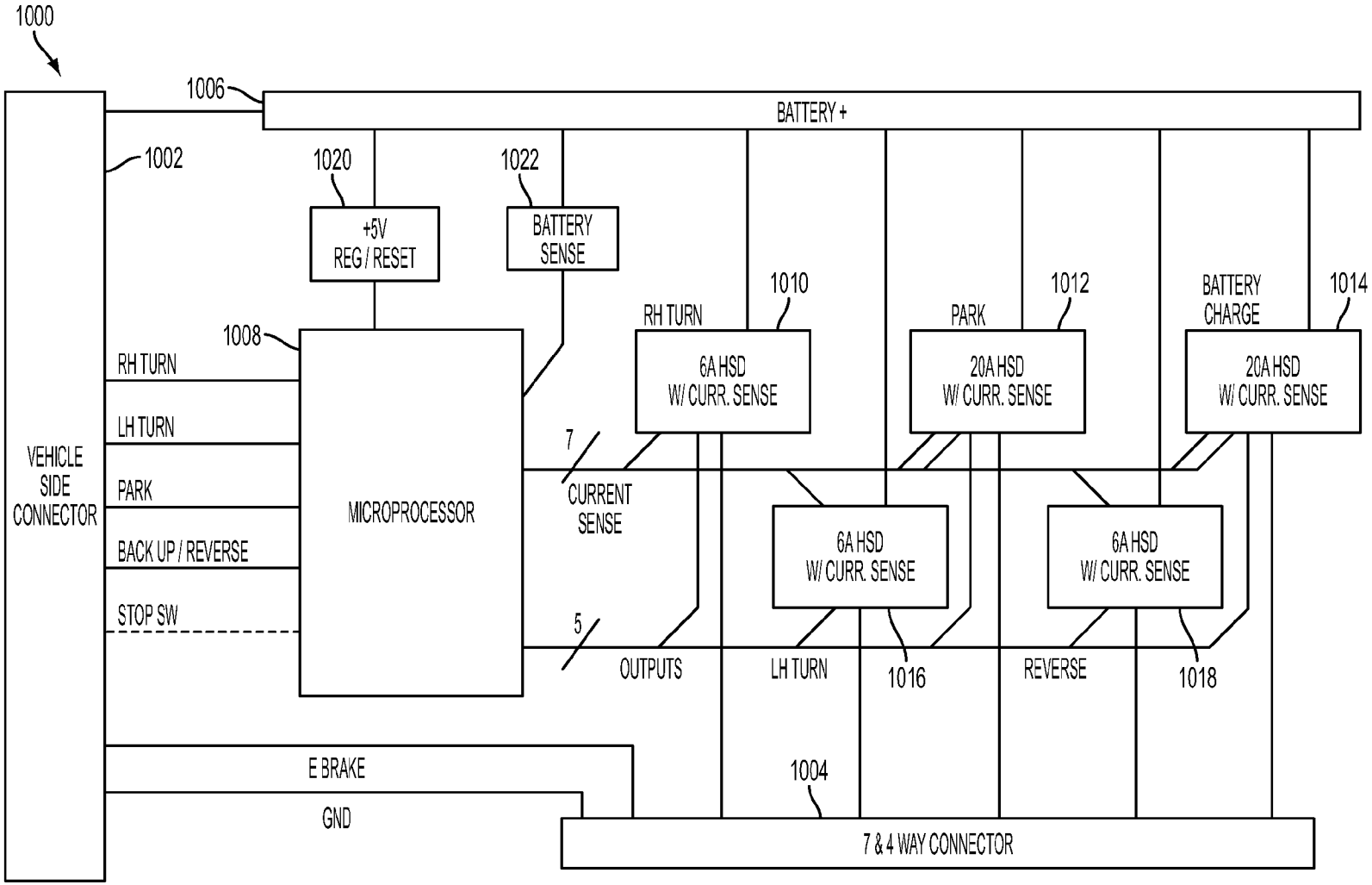
FIG. 10 is a block diagram of an exemplary embodiment of interface electronics useful in a connector assembly consistent with the present disclosure.

Turning now to FIG. 10, there is provided a block diagram of an exemplary configuration for the interface electronics 1000 useful in a connector assembly consistent with the present disclosure. As described above, the electronics may be provided on one or more PCBs assembled to the connector assembly. The electronics provide an interface between the 7-way and 4-way connector terminals 1004 and the vehicle bus through a harness terminal connector interface 1002.

In the illustrated exemplary embodiment, four active high digital inputs, right hand (RH) turn, left hand (LH), park, backup/reverse (and an optional Stop Sw input), are provided from the harness terminal connector interface 1002 to a microprocessor 1008, such as a Infeon XC866 processor. The processor 1008 may be programmed to control connection of battery power in response to the inputs for thereby enabling the RH turn, LH turn, reverse and park lights on the towed apparatus, along with a small light and battery charging function, by connecting battery power through the harness terminal connector interface 1002 to appropriate ones of the four and seven-way connector terminals 1004.

The battery power may be connected to the four and seven-way terminals 1004 through associated electronic high-side driver (HSD) relays 1010, 1012, 1014, 1016, 1018. In the illustrated exemplary embodiment, the RH Turn 1010, LH turn 1016, and reverse 1018 HSDs may provide a maximum 6A output to the towed apparatus through the terminals 1004. The park lamp/small light 1012 and battery charge 1015 HSDs may be configured to drive 20A and may be implemented by paralleling dual Smart High side drivers with current sense. All the HSDs may include RDS allowing for a low voltage drop capable of meeting FMVSS requirements and may be self-protected against overload and short to GND. Current sense outputs from the HSDs may be provided to the processor 1008, which can be programmed to implement resistive open load detection by looking at the current sense outputs of the HSD during the on condition. The electronics 1000 may also include circuits for monitoring the battery voltage 1022 and for providing a regulated voltage 1020 to the processor.

Figure 11:
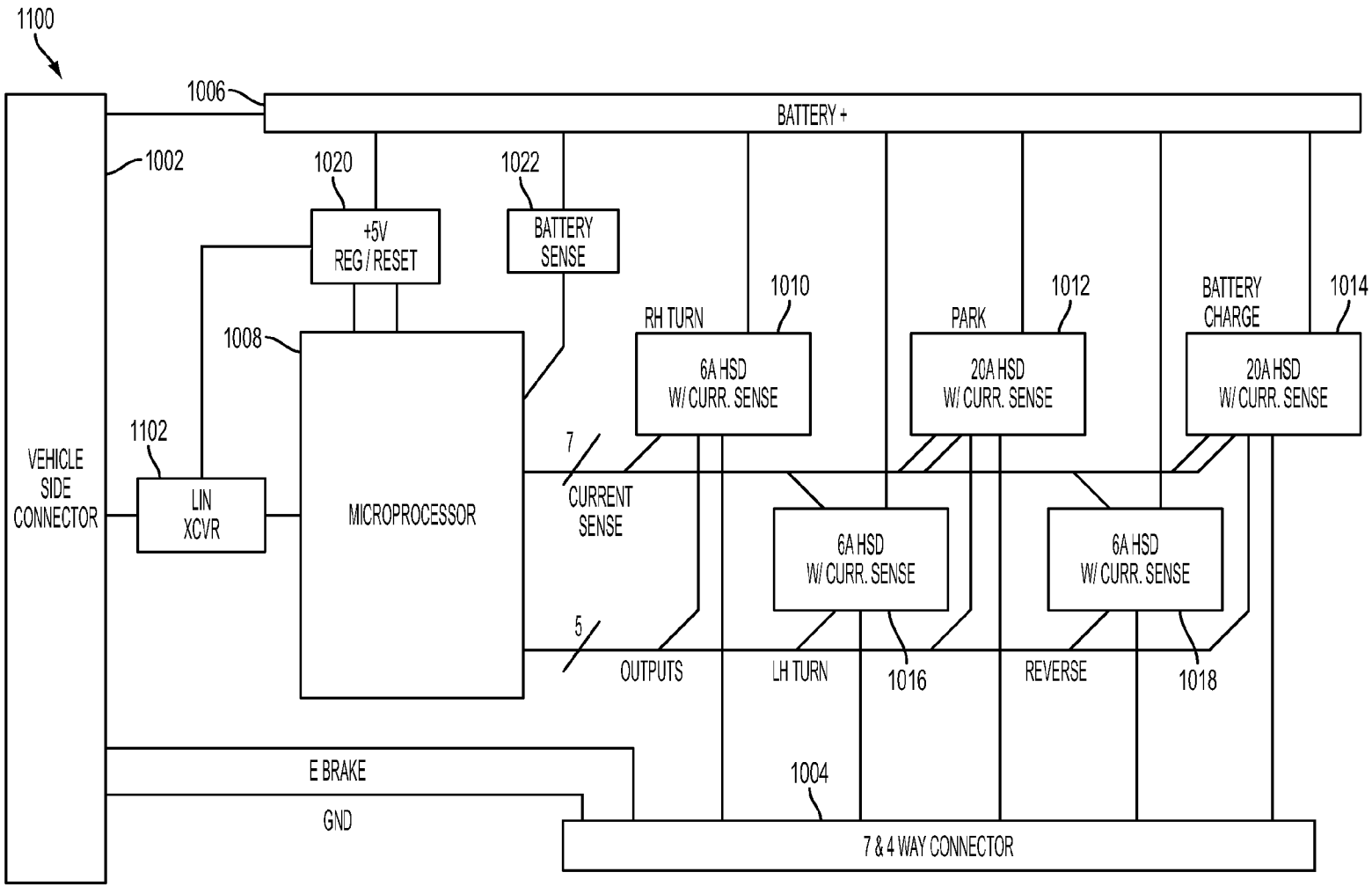
FIG. 11 is a block diagram of another exemplary embodiment of interface electronics useful in a connector assembly consistent with the present disclosure.

FIG. 11 is a block diagram, there is provided a block diagram of an exemplary configuration 1100 for the interface electronics useful in a connector assembly consistent with the present disclosure. The illustrated exemplary embodiment 1100 is substantially the same as the embodiment illustrated in FIG. 10, except for the inclusion of a Slave LIN 2.0 interface for communication with a main body controller acting as a master, e.g. in the towing vehicle. The LIN interface reduces the number of wires and facilitates diagnostics of the outputs like open load, short circuit, currents sense and other data like battery voltage.

Computer programs or applications for execution by the processor 1008 may be stored in local processor memory, e.g. RAM, or other machine readable medium (e.g., a hard disk, a CD ROM, a system memory, optical memory, etc.) and may be executed by the processor to cause the processor to perform all or part of the functions described herein as being performed by the processor 1008. It is expected that such a computer program product may be distributed as a removable machine-readable medium (e.g., a diskette, CD-ROM), preloaded with a system (e.g., on system ROM or fixed disk), or distributed from a server or electronic bulletin board over a network (e.g., the Internet or World Wide Web).

According to one aspect of the present invention, therefore, there may be provided an electrical connector including: a body; a first connector portion disposed at least partially in the body and including a first number of first connector terminals; and a second connector portion disposed at least partially in the body and separate from the first connector portion and including a second number of second connector terminals, the second number being greater than the first number; and interface electronics disposed the body for providing an electrical interface between the first and second connector terminals and a vehicle bus.

According to one aspect of the present invention, therefore, there may be provided an electrical connector including: a body; a first connector portion disposed at least partially in the body and including a first number of first connector terminals; and a second connector portion disposed at least partially in the body and separate from the first connector portion and including a second number of second connector terminals, the second number being greater than the first number; a first printed circuit board disposed at least partially in the body; a second printed circuit board at least partially disposed in a space provided in the body and arranged generally perpendicular to the first printed circuit board; and interface electronics disposed on the first and second printed circuit boards for providing an electrical interface between the first and second connector terminals and a vehicle bus.

It should be understood that the various features and aspects of the exemplary connectors described herein may be combined with one another. Furthermore, the features and aspects of the invention herein are susceptible to use with other electrical connectors in addition to the exemplary seven-way and four-way electrical connection between a vehicle and a towed apparatus. The embodiments that have been described herein are but some of the several which utilize this invention and are set forth here by way of illustration, but not of limitation. It is obvious that many other embodiments, which will be readily apparent to those skilled in the art may be made without departing materially from the spirit and scope of the invention.

What is claimed is:

1. An electrical connector comprising:

a body;

a first connector portion disposed at least partially in said body and comprising a first number of first connector terminals; and a second connector portion disposed at least partially in said body and separate from said first connector portion and comprising a second number of second connector terminals, said second number being greater than said first number;

a first printed circuit board disposed at least partially in said body;

a second printed circuit board, said second printed circuit board being separate from said first printed circuit board and at least partially disposed in a space provided in said body and arranged generally perpendicular to said first printed circuit board, said space being provided in said body between said first and second connector portions; and interface electronics disposed on said first and second printed circuit boards for providing an electrical interface between said first and second connector terminals and a vehicle bus.

2. A connector according to claim 1, wherein ends of said second connector terminals extend through said first printed circuit board for electrical connection to said interface electronics.

3. A connector according to claim 1, wherein ends of said second connector terminals extend through said first printed circuit board for electrical connection to said interface electronics.

4. An electrical connector according to claim 1, said connector further comprising:

a first cover pivotally coupled to said body adjacent said first connector portion;

a second cover pivotally coupled to said body adjacent said second connector portion; and a biasing element biasing said first cover toward a closed position relative to said first connector portion and biasing said second cover toward a closed position relative to said second connector portion.

5. An electrical connector according to claim 4, wherein said first and second cover are pivotally coupled to said body by a common pin, and wherein said space is dispose in said body generally beneath said common pin.

6. An electrical connector according to claim 4, wherein said biasing element comprises a spring applying a biasing force to said first cover and to said second cover.

7. An electrical connector according to claim 4, wherein said first and second cover are pivotally coupled to said body by a common pin, and wherein said space is dispose in said body generally beneath said common pin.

8. An electrical connector according to claim 4, wherein said biasing element comprises a spring applying a biasing force to said first cover and to said second cover.

9. An electrical connector comprising:

a body;

a first connector portion disposed at least partially in said body and comprising a first number of first connector terminals; and a second connector portion disposed at least partially in said body and separate from said first connector portion and comprising a second number of second connector terminals, said second number being greater than said first number;

a first cover pivotally coupled to said body adjacent said first connector portion;

a second cover pivotally coupled to said body adjacent said second connector portion;

a biasing element biasing said first cover toward a closed position relative to said first connector portion and biasing said second cover toward a closed position relative to said second connector portion;

a first printed circuit board disposed at least partially in said body;

a second printed circuit board, said second printed circuit board being separate from said first printed circuit board and at least partially disposed in a space provided in said body between said first and second portions and arranged generally perpendicular to said first printed circuit board; and interface electronics disposed on said first and second printed circuit boards for providing an electrical interface between said first and second connector terminals and a vehicle bus.

* * * * *